United States Patent [19]

Hixson

[11] 4,062,490

[45] Dec. 13, 1977

[54] RAIL FASTENING CLIPS

[75] Inventor: Richard M. Hixson, McLean, Va.

[73] Assignee: Transit Products Company, Inc., Washington, D.C.

[21] Appl. No.: 666,037

[22] Filed: May 21, 1976

[51] Int. Cl.[2] ..... E01B 9/46

[52] U.S. Cl. ..... 238/338; 238/264; 238/310

[58] Field of Search ..... 238/264, 278, 283, 310, 238/315, 338, 349

[56] References Cited

U.S. PATENT DOCUMENTS

| | | | |
|---|---|---|---|
| 3,386,657 | 6/1968 | Kramer | 238/310 |
| 3,576,293 | 4/1971 | Landis et al. | 238/264 X |
| 3,616,999 | 11/1971 | Ruble | 238/315 |
| 3,784,098 | 1/1974 | Serafin et al. | 238/349 |

FOREIGN PATENT DOCUMENTS

| | | | |
|---|---|---|---|
| 1,658,363 | 10/1970 | Germany | 238/315 |
| 282,010 | 4/1952 | Switzerland | 238/264 |

*Primary Examiner*—Robert J. Spar
*Assistant Examiner*—Randolph A. Reese
*Attorney, Agent, or Firm*—Larson, Taylor and Hinds

[57] ABSTRACT

A rail fastening clip which secures a rail to a mounting or support structure which allows some flexing of the rail. The clip is constructed of a hard durable material and is provided with a fulcrum point to permit a small amount of longitudinal flexion of the rail. The clip is also provided with resilient inserts to permit the fastening clip to allow the rail to expand, thus compensating for longitudinal forces. The fastening clip is constructed for use with existing rail fastening base assemblies.

5 Claims, 8 Drawing Figures

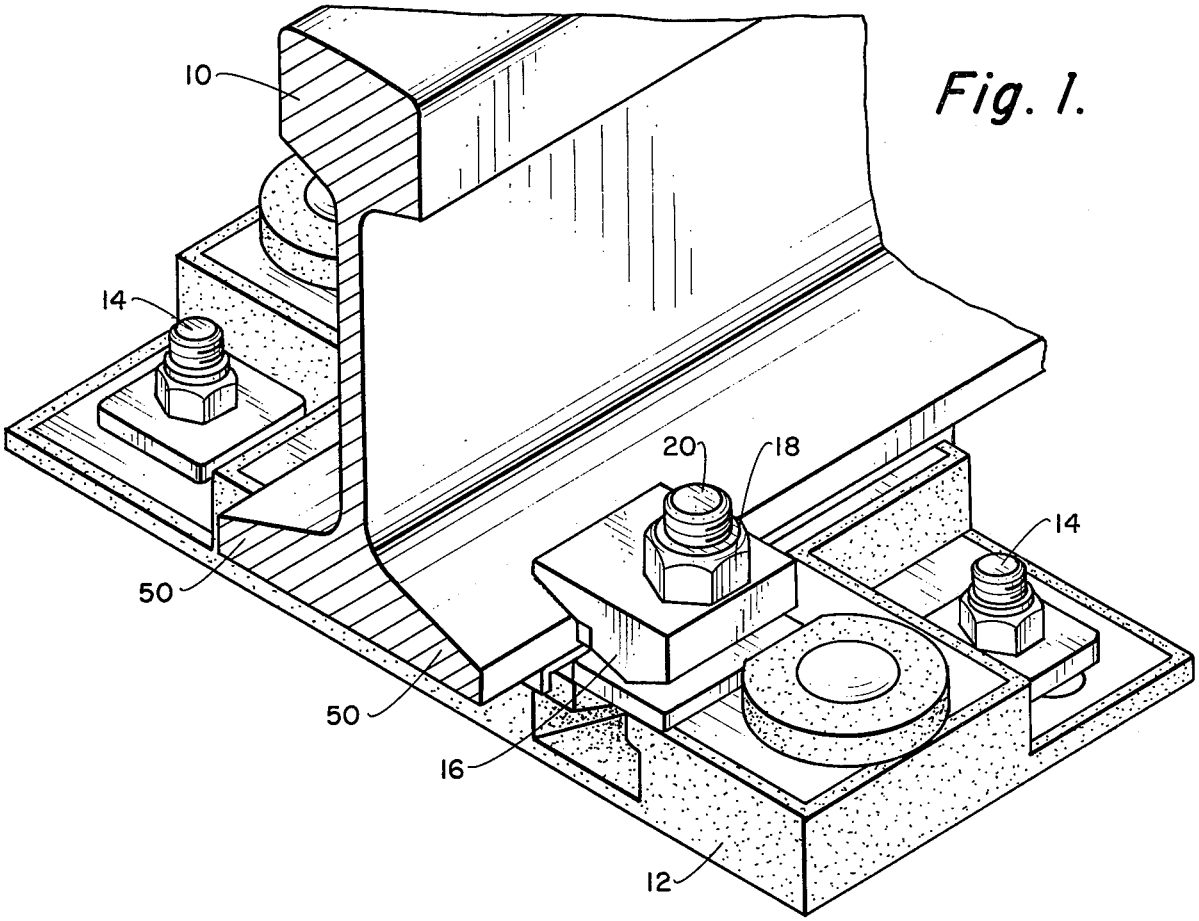
Fig. 1.
Fig. 5.
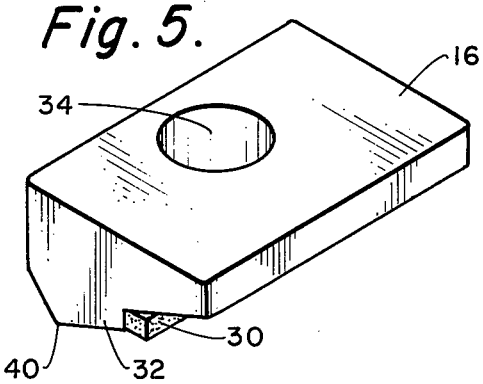
Fig. 6.
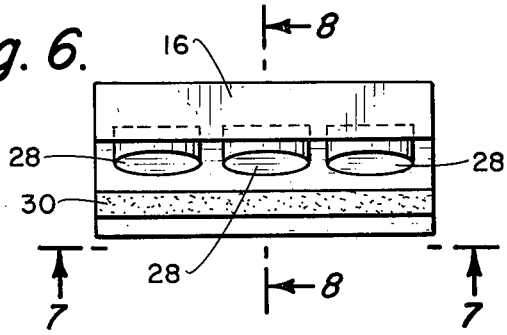
Fig. 7.
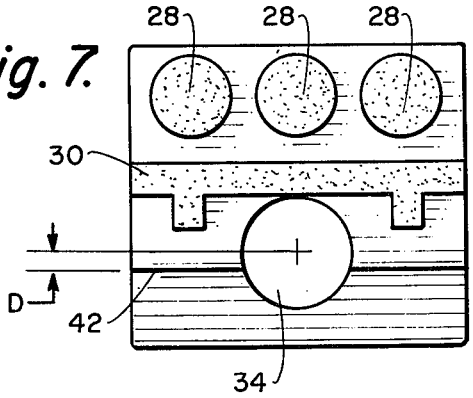
Fig. 8.
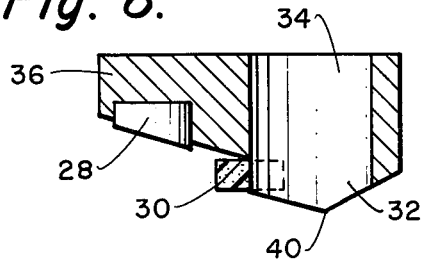

RAIL FASTENING CLIPS

BACKGROUND OF THE INVENTION

This invention relates generally to rail fastening devices and more particularly relates to a rail fastening clip incorporating flexibility. The rail fastening clip disclosed herein is for use with rail fastening assemblies, such as that disclosed in U.S. Pat. No. 3,858,804, issued Jan. 7, 1975.

Rail clips securely hold a rail in position on a mounting base by extending over the base flange of the rail and clamping it down. Usually the base has a bolt extending through the clip and a nut fastens the clip down to the base to clamp the rail. The clips are usually constructed of very high strength material and secured with tremendous forces to hold the rail relatively immovable. However, because of the design of some structures, it is not desirable to hold the rail completely immobile.

SUMMARY OF THE INVENTION

The purpose of this invention is to allow the rail to move through the rail clips longitudinally, but not laterally. In this sense the rail clips of the present invention allow the rail to move with the heat expansion compensating members. The clip is constructed to have a fulcrum point to allow some rotational flexure of the clip. In addition there are resilient members beneath the clip which allow some slippage of the rail. The tongue of the clip has resilient pads which, when the clip is clamped with a great deal of force on the rail, still allows the rail to expand or exert longitudinal forces. The clip is still secured in the normal fashion with a bolt anchored in a base assembly passing through the clip and a nut securely clamping the clip down on the base flange of a rail.

It is one object of the present invention to provide a rail fastening clip which compensates for longitudinal forces exerted on a rail.

Another object of the present invention is to provide a rail fastening clip which may be used with existing rail fastening base assemblies.

Yet another object of the present invention is to provide a rail fastening clip which has resilient members incorporated therein Still another object of the present invention is to provide a rail fastening clip which permits longitudinal movement even when truly fastened.

Other objects, advantages and novel features of the invention will become apparent from the following detailed description of the invention when considered in conjunction with the accompanying drawings, wherein like reference numbers identify like parts throughout the drawings.

BRIEF DESCRIPTION OF THE DRAWINGS

FIG. 1 is a perspective view of a rail fastening assembly incorporating the novel rail fastening clip.

FIG. 5 is a perspective view of the rail fastening clip.

FIG. 6 is a side elevation of the rail fastening clip showing the resilient inserts.

FIG. 7 is a bottom view of the rail fastening clip taken at 7—7 of FIG. 6.

FIG. 8 is a sectional side elevation taken at 8—8 of FIG. 6.

DETAILED DESCRIPTION OF THE PREFERRED EMBODIMENT

Figure 4:
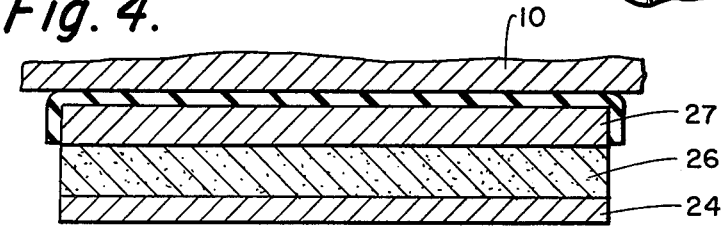
FIG. 4 is a partial section taken at 4—4 of FIG. 2.

Referring to FIG. 1, a rail 10 is supported on a base assembly 12, which is secured by anchor bolts 14 embedded in a pad (not shown). The rail 10 is clamped to the base rail fastening assembly 12 by means of clips 16 secured by a nut 18 attached to bolts 20 secured to base assembly 12. The base assembly 12 is shown in FIG. 4 and is made up of a top plate 22 and a bottom plate 24 between which is sandwiched a resilient material 26 of rubber or other appropriate elastomeric material as is described in the above referenced U.S. Pat. No. 3,858,804.

The novel rail fastening clip 16 is shown in FIGS. 5 through 8. In order to compensate for forces and loads on the rail 10, the clip 16 is provided with resilient pads 28 which permit the rail 10 to expand and allow the clip to accommodate this expansion. That is, the clip allows the rail 10 to expand or move longitudinally and slip on the resilient pads 28. Another resilient pad 30 is provided in the heel portion 32 of the rail fastening clip 16. A mounting hole 34 is provided in the clip and may be in the form of a slot, if desired, to provide adjustment.

In addition to the resilient pads in the heel 32 and toe 36 of the clip 16, another feature which permits compensation for bending forces and loads is a fulcrum point 40 provided on the bottom of the heel portion 32. The fulcrum point 40 permits full torque to be placed on the bolt 20 and nut 18, while still allowing some slight rocking of the clip when securely fastening the rail 10. The fulcrum point 40 runs the entire length of the bottom of the heel portion 32 as shown by the line 42 in FIG. 7.

Figure 2:
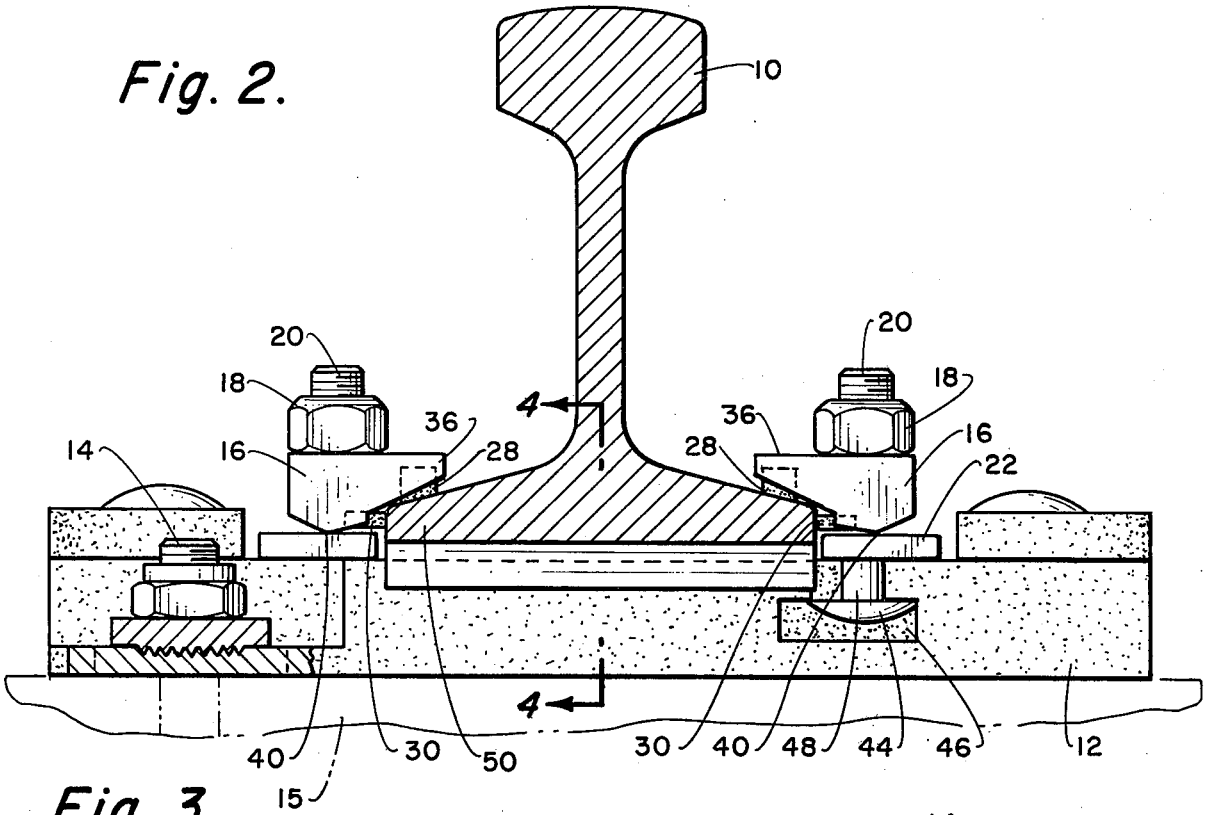
FIG. 2 is a side elevation of a rail fastening base assembly incorporating the novel fastening clip.
Figure 3:
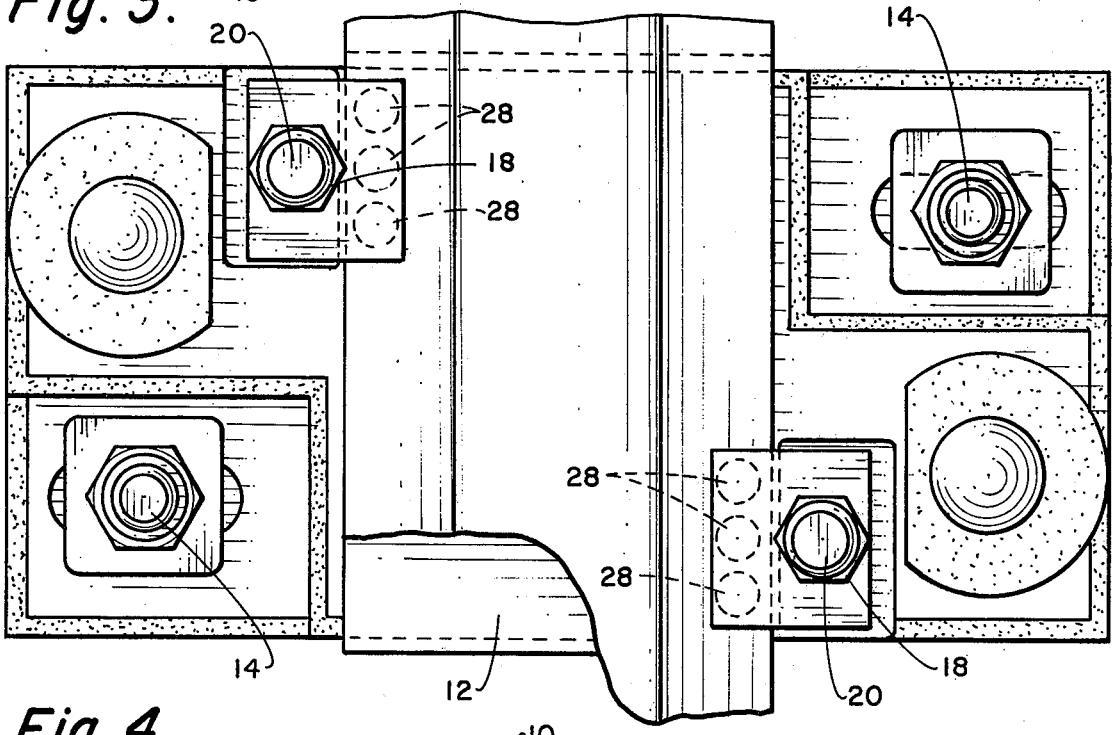
FIG. 3 is a top elevation of the rail fastening assembly of FIG. 2.

The rail fastening clip is shown installed in FIGS. 2 and 3. In FIG. 2 the rail 10 is placed on the base 12 and fastened by studs or anchor bolts 14 embedded in the pad 15. The rail 10 is securely clamped by the clips 16 which are fastened by bolts 20 and nuts 18. When the nuts 18 are tightened down on the clips 16, a rotational force is exerted on the toe portions 36 by the fulcrum point 40 of each clip. This occurs because the fulcrum point is slightly spaced from the center of the mounting hold 34 a distance D shown in FIG. 7. If the mounting holes 34 are slotted to permit some adjustment, then the fulcrum point 42 obviously will have to be spaced such that the slight torque in the direction of the toe portion 36 is produced.

The bolts 20 are secured to the base 12 by head 44 which engages a slot 46 in the base with the shaft 48 of the bolt passing up through the top plate 22 of the base 12. The resilient pads 28 and 30, as can be seen in FIGS. 2 and 3, press against the side and the top of the base flange 50 of the rail 10, securing the rail in a firm position, but permitting some movement to compensate for bending forces and loads. In addition, the resilient pads 28 and 30 permit these forces, but at the same time the fulcrum on the rail fastening clip 16 prevents any loosening of the nut 18 because of the torque on the toe portion providing a reactive force maintaining and locking the nut 18. Thus, while the rail fastening clip 16 permits some movement of the rail 10, the torquing action of the fulcrum 40 allows the rail to be securely fastened without any loosening of the nut 18 permitted.

Obviously, many modifications and variations of the present invention are possible in the light of the above teachings. It is therefore to be understood that the full scope of the invention is not limited to the details disclosed herein and may be practiced otherwise than as specifically described.

What is claimed is:

1. A rail fastening assembly for mounting a rail on a supporting bed comprising:

a base assembly;

fastener means including at least one stud extending through said base assembly for holding said base assembly securely to said supporting bed;

a least one rail clip supported on said base assembly, said clip having a heel portion and a toe portion; and torque producing means on the heel portion of said clip for, in use when clamping a rail, generating a torque on said toe portion, said base assembly including an upper plate presenting a flat surface and said torque producing means comprising a fulcrum-forming knife edge, located intermediate the ends of said heel portion of said clip on the underside of said heel portion and extending across the width of said heel portion, which engages said flat surface of said upper plate, said fastening assembly further including bolt means for bolting said clip to said base assembly, so that said toe securely engages the rail while permitting a degree of longitudinal movement of the rail, said bolt means including a bolt which extends vertically through said clip and through the knife edge thereof.

2. The rail assembly according to claim 1 including resilient means on said clip for absorbing forces and loads on the rail.

3. The rail assembly according to claim 2 wherein said resilient means comprises at least one resilient pad on the underside of the toe portion of said clip.

4. The rail assembly according to claim 3 wherein said resilient means also includes a resilient pad along the inside edge of said heel portion adjacent to said toe portion.

5. The rail assembly according to claim 4 wherein said resilient means comprises a plurality of pads equally spaced along the underside of the toe of said clip.

* * * * *